United States Patent [19]

Hope et al.

[11] 4,026,451

[45] May 31, 1977

[54] CONVEYOR APPARATUS FOR PROCESSING PHOTOGRAPHIC MATERIALS

[76] Inventors: Henry F. Hope; Stephen F. Hope, both of 2548 Wyandotte Road, Willow Grove, Pa. 19090

[22] Filed: Oct. 30, 1975

[21] Appl. No.: 627,284

[52] U.S. Cl. ..... 226/91; 226/189; 354/320

[51] Int. Cl.² ..... B65H 17/22

[58] Field of Search ..... 226/90, 91, 92, 189, 226/181, 188; 354/319, 320, 322

[56] References Cited

UNITED STATES PATENTS

| | | | |
|---|---|---|---|
| 3,520,461 | 7/1970 | Savela | 226/188 |
| 3,779,439 | 12/1973 | Fessop | 226/189 X |
| 3,785,543 | 1/1974 | Lee | 226/189 X |
| 3,830,419 | 8/1974 | Lee | 226/189 X |
| 3,858,870 | 1/1975 | Yabe | 226/189 X |

*Primary Examiner*—Richard A. Schacher

*Attorney, Agent, or Firm*—Zachary T. Wobensmith, II; Zachary T. Wobensmith, III

[57] ABSTRACT

Conveyor apparatus for processing photographic materials is disclosed and more specifically equipment for turnaround during processing of an elongated web of photographic material at the midportion of a processing operation, a plurality of parallel inner and outer driven rollers being employed to receive and direct the web for turnaround, the outer rollers being disposed at spaced locations along the outside of the turnaround path, the inner rollers also being disposed along the inside of the turnaround path and being spaced from and having their axes offset from a radial plane through the outer rollers and the center of the turnaround path, the inner and outer rollers being disposed for advancing the web without pinching of the web and free from contact with fixed guides which tend to scratch or mar the surface being processed, an improved and compact drive being provided particularly for the inner rollers.

8 Claims, 10 Drawing Figures

FIG. 5
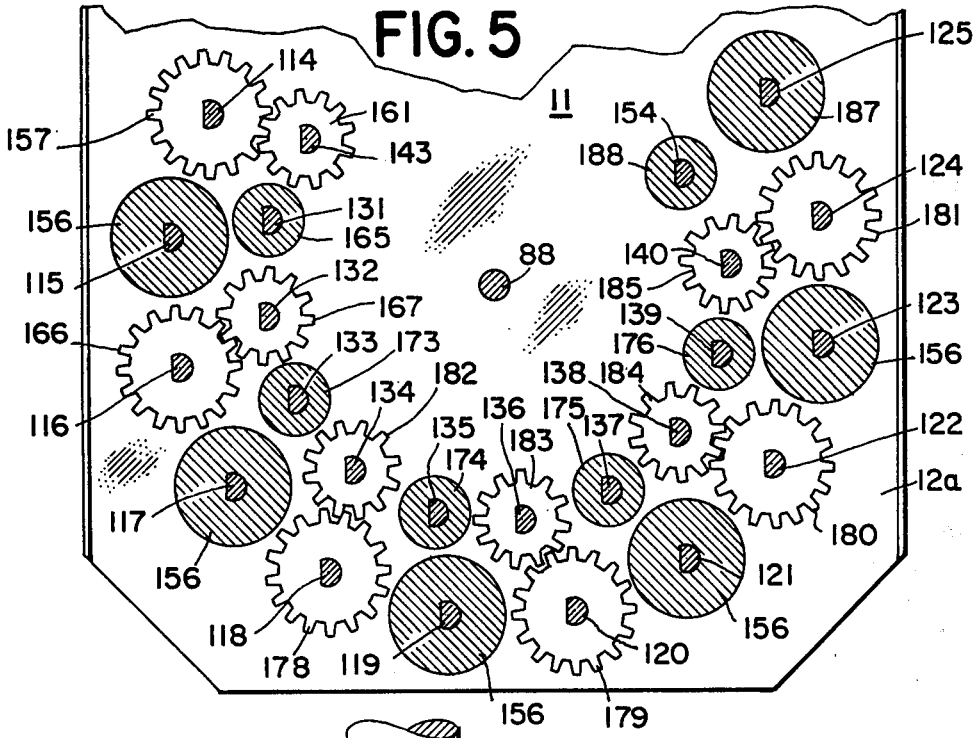
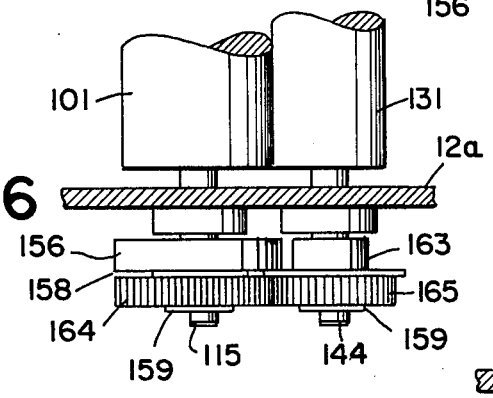
FIG. 6
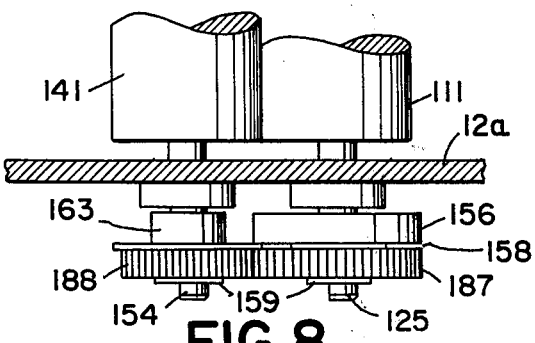
FIG. 8
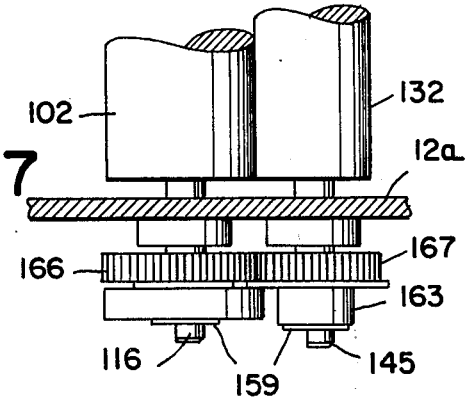
FIG. 7
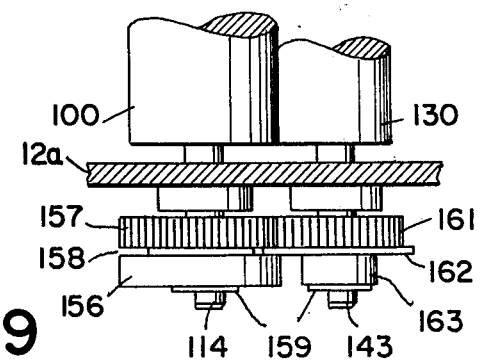
FIG. 9

CONVEYOR APPARATUS FOR PROCESSING PHOTOGRAPHIC MATERIALS

BACKGROUND OF THE INVENTION

1. Field of the Invention

This invention relates to apparatus for the processing of webs of photographic materials and the like and more particularly to an improved turnaround for handling the web in a processing tank and for reversal of the direction of the web in the midportion of the processing.

2. Description of the Prior Art

It has heretofore been proposed to direct an elongated strip or web of photographic material through a tank for processing. The apparatus heretofore employed included, in sequence, pairs of introducing rollers at the top of the tank, downwardly directing pairs of rollers with a turnaround at the bottom of the tank, and upwardly directing pairs of rollers with pairs of delivery rollers at the top of the tank on the opposite side from the introducing rollers. The turnaround structure heretofore employed included nip rolls between which the web was gripped, for advancing the web and interposed guide plates for directing the web from one set of nip rolls to the next.

The use of nip rolls for propulsion of the web within the processing fluid as well as the use of guide plates for directing the web, had a tendency to scratch the web and did not provide the best exposure of the web to the processing fluid with agitation of the fluid and soft or delicate webs would collapse upon contact with the guide plates. The prior apparatus also had high power requirements due to the internal friction of the driving mechanism for the web. Nip rolls are also troublesome in use because of the difficulty in maintaining constant pressure on the web to drive the web to avoid slipping because of insufficient pressure and to avoid pinching and bruising because of excessive pressure.

SUMMARY OF THE INVENTION

The apparatus of the present invention includes inner and outer rollers for advancing the web in a processing tank with a turnaround at the midportion of the path, inner and outer rollers being disposed in an offset relation of interacting pairs to advance the web without undue pressure thereon, to avoid scratching, to avoid skewing of the web or collapse of a delicate web during its advance, to provide improved exposure of the web to the processing liquid with agitation of the processing liquid, a compact gear drive being provided so that the teeth of one gear cannot interfere with those of contiguous gears with which it is not in driving relation under conditions of limited space.

It is the principal object of the invention to provide a turnaround for photographic web processing apparatus with which improved handling of the web is effected, and with reduced power requirements.

It is a further object of the invention to provide a turnaround for web processing with which the likelihood of damage to the web during processing is greatly reduced.

It is a further object of the invention to provide a turnaround for web processing having a simple but effective gear drive.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which:

FIG. 5 is a fragmentary vertical sectional view of a portion of the gear drive for the turnaround taken on a plane spaced inwardly from the plane on which FIG. 4 was taken;

FIG. 6 is fragmentary vertical sectional view taken approximately on the line 6—6 of FIG. 4;

FIG. 7 is a fragmentary vertical sectional view taken approximately on the line 7—7 of FIG. 4;

FIG. 8 is a fragmentary vertical sectional view taken approximately on the line 8—8 of FIG. 4;

FIG. 9 is a fragmentary vertical sectional view taken approximately on the line 9—9 of FIG. 4.

Figure 1:
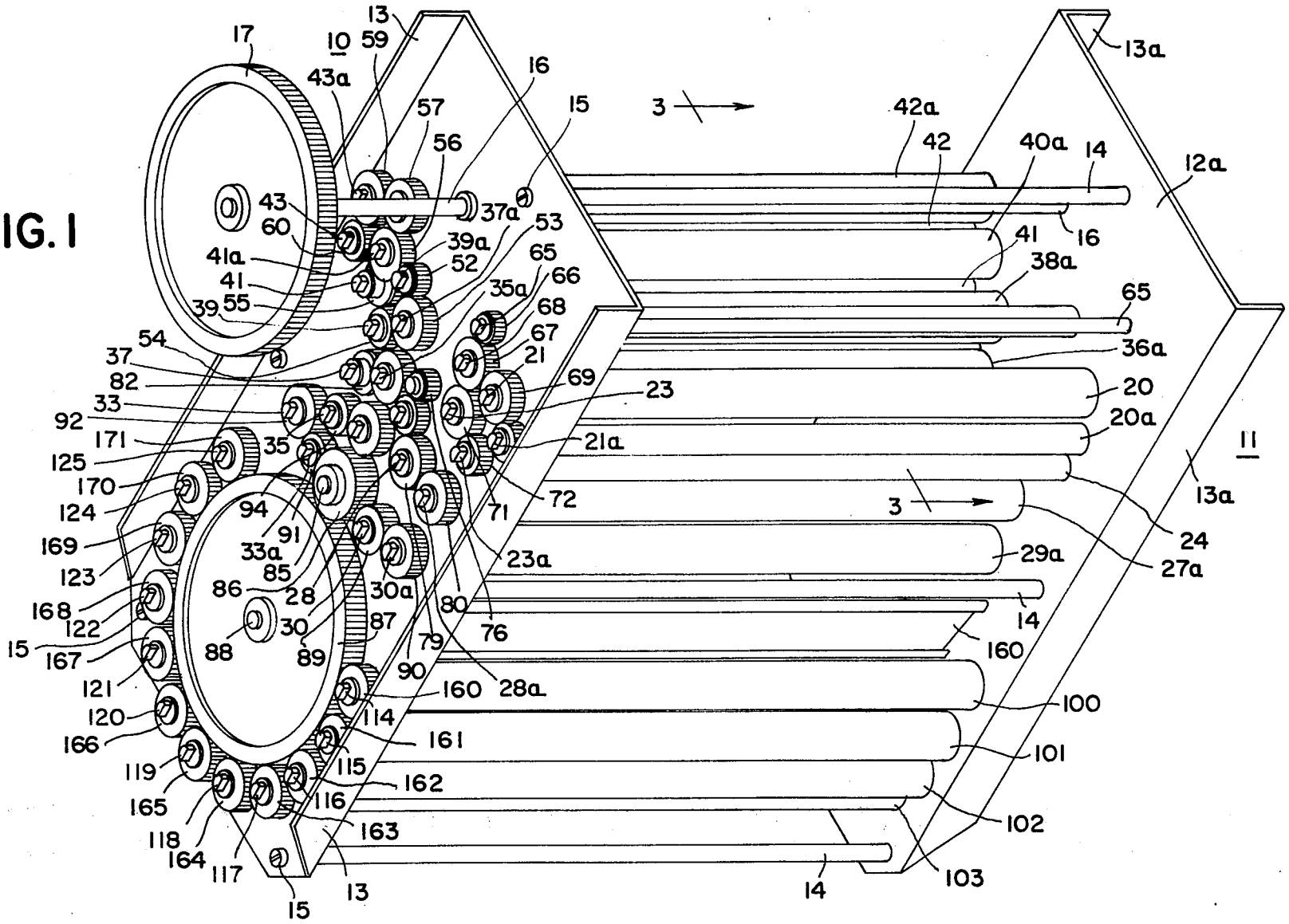
FIG. 1 is a view in perspective of web processing apparatus with the web turnaround in accordance with the invention incorporated therein and shown as removed from the processing tank.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings, end frames 10 and 11 are shown, of any suitable material, including metal or plastic, of sufficient strength and resistant to the chemicals and liquids to which they are exposed in use. The bearings and bushings employed in the end frames 10 and 11 have been omitted in the interest of clarity.

The end frames 10 and 11 each includes central plate portions **12, 12*a* and edge ribs 13, 13*a* for stiffening the end plates 10 and 11 being held in assembled relation by frame rods 14 and studs 15 engaging the plate portions 12, 12*a* and threaded into the rods 14.**

The end frames 10 and 11 have journaled therein a power input shaft 16 which carries a power input gear 17 driven by any suitable source, such as an electric motor (not shown).

Figure 3:
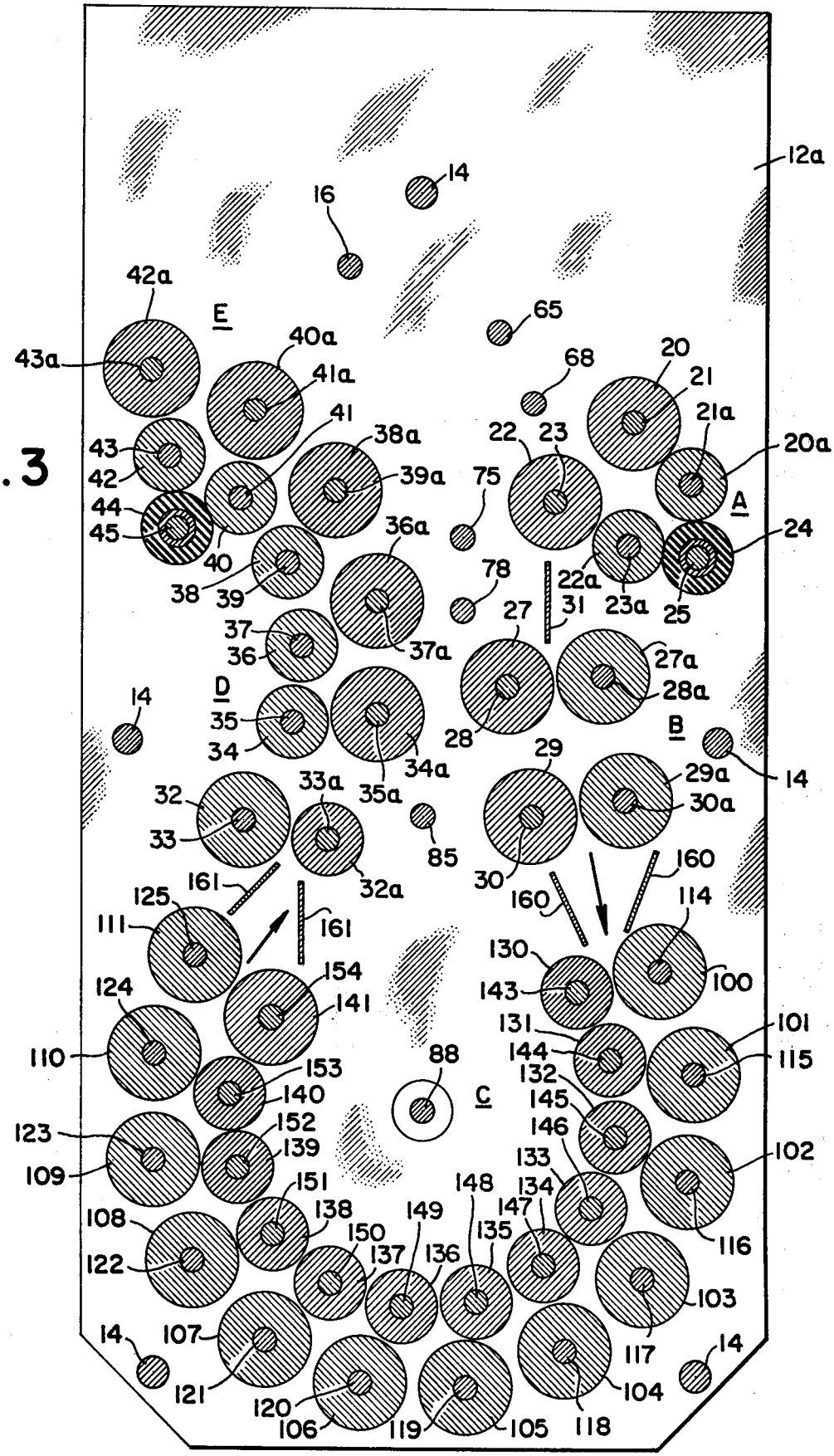
FIG. 3 is a vertical sectional view taken approximately on the line 3—3 of FIG. 1.

A plurality of rollers to be described, are employed and these (see FIG. 3) include an infeed section A, a downfeed section B, the turnaround section C, an upfeed section D and a delivery section E.

The infeed section A, shown merely by way of illustration, includes pairs of infeed rollers 20 and **20*a* on shafts 21 and 21*a*, pairs of rollers 22 and 22*a* on shafts 23 and 23*a*, and a liquid applying roller 24 on a shaft 25.**

The downfeed section B, shown merely be way of illustration, includes pairs of downfeed rollers 27 and **27*a* on shafts 28 and 28*a***, and pairs of downfeed rollers 29 and 29*a* on shafts 30 and 30*a*. A guide plate 31 may be provided to facilitate initial insertion of the leading end of the web for introduction and passage between the rollers 27 and 27*a*.

The upfeed section D, shown merely by way of illustration, includes pairs of upfeed rollers 32 and 32*a* on shafts 33 and 33*a* and pairs of upfeed rollers 34 and 34*a* on shafts 35 and 35*a*.

The delivery section E, shown merely by way of illustration, includes pairs of rollers 36 and 36*a* on shafts 37 and 37*a*, pairs of rollers 38 and 38*a* on shafts 39 and 39*a*, pairs of rollers 40 and 40*a* on shafts 41 and 41*a*, pairs of rollers 42 and 42*a* on shafts 43 and 43*a* and a wiper roller 44 on shaft 45.

The infeed section, delivery section, downfeed section and upfeed section rollers are driven through gear trains preferably composed of gears of synthetic plastic material of low coefficient of friction and resistant to corrosion upon exposure in the processing fluid to which the web is exposed. The portions of the roller shafts on which the gears are carried are preferably of D-cross section to serve as positive keyed connections to complemental openings in the gears. The gears may be mounted on the D-cross sections so as to be slidable to a limited extent to permit accommodation and proper meshing.

Figure 2:
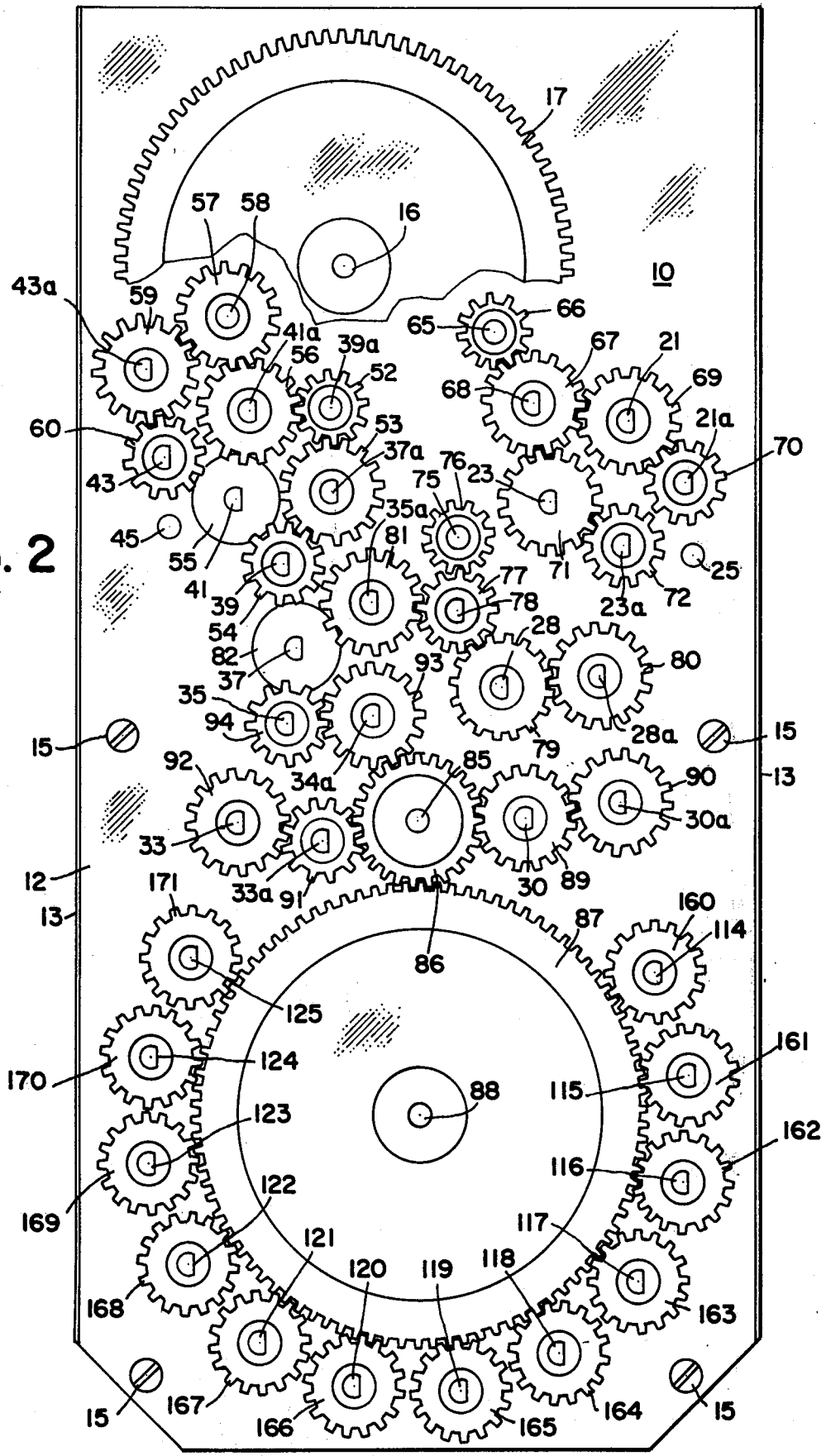
FIG. 2 is an end elevational view of the apparatus shown in FIG. 1 as seen from one end.
Figure 4:
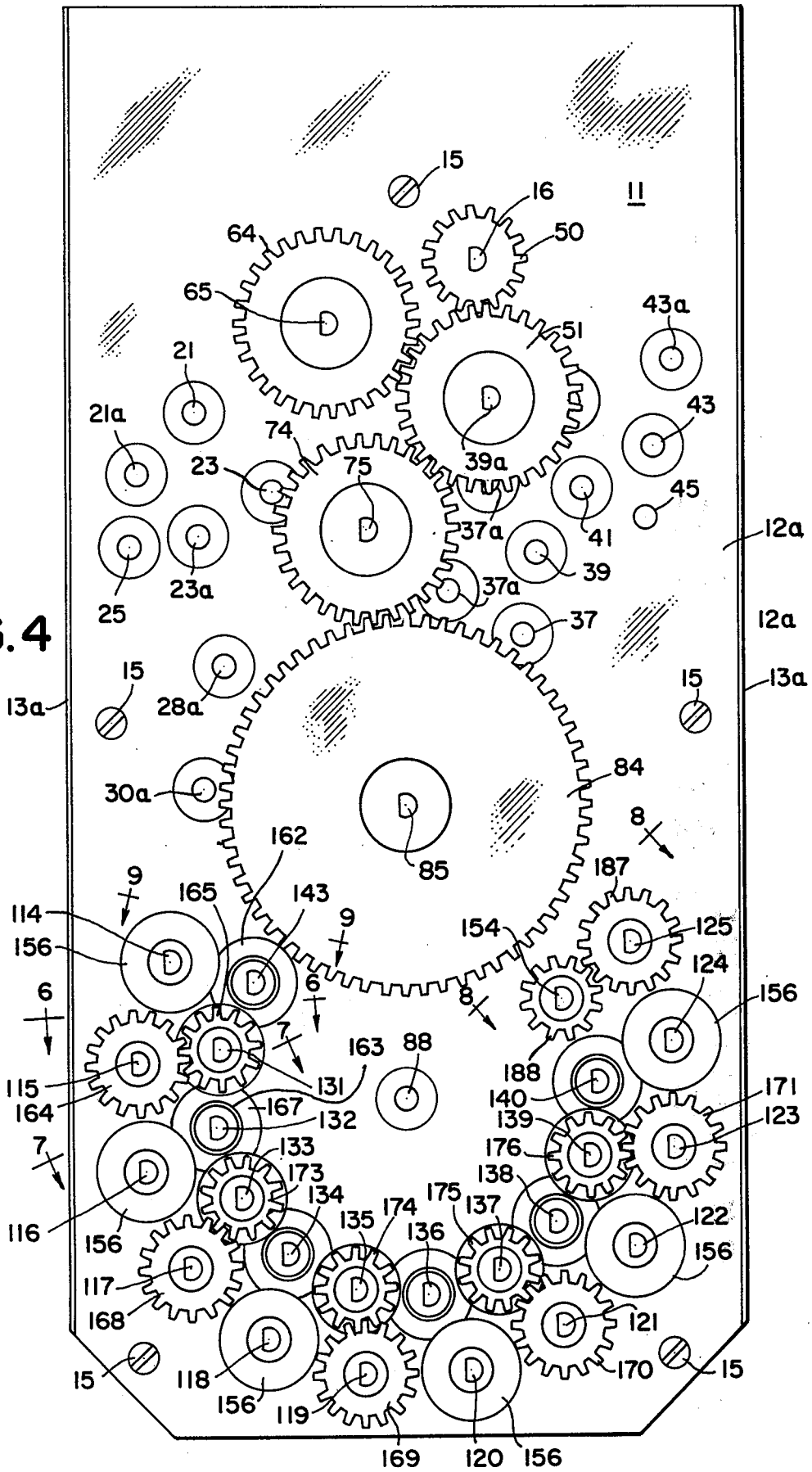
FIG. 4 is an end elevational view of the apparatus shown in FIG. 1 as seen from the other end.

These gear trains include (see FIGS. 2 and 4) a gear 50 on shaft 16, in driving engagement with a gear 51 on shaft 39*a* through shaft 39*a* having a gear 52 on its other end driving gear 53 on shaft 37*a* which in turn drives gear 54 on shaft 39. The gear 54 has an inner counterpart which is in driving engagement with an inwardly facing gear 55 on shaft 41. The gear 55 is in driving engagement with an inner gear counterpart 56 on the shaft 41. The outer gear part 56 on shaft 41*a* is in driving engagement with an idler gear 57 on an idler shaft 58, the gear 57 being in driving engagement with a gear 59 on shaft 43*a* which in turn is in driving engagement with the gear 60 shaft 43.

The gear 51 is in driving engagement with a gear 64 on a shaft 65 having a gear 66 in driving engagement with a gear 67 on a shaft 68. The gear 67 is in driving engagement with a gear 69 on the shaft 21 which in turn as in driving engagement with a gear 70 on the shaft 21*a*.

The gear 67 is also in driving engagement with a gear 71 on the shafts 23 which in turn is in driving relation to a gear 72 on the shaft 23*a*.

The gear 51 is in driving engagement with a gear 74 on a shaft 75. The shaft 75 on the opposite end has a gear 76 which is in driving engagement with a gear 77 on a shaft 78.

The gear 77 is in driving engagement with a gear 79 on the shaft 28 which in turn is in driving engagement with a gear 80 on the shaft 28*a*.

The gear 77 is also in driving engagement with a gear 81 on the shaft 35*a* which is in driving engagement with an inwardly facing gear 82 on the shaft 37.

The gear 74 is in driving engagement with a gear 84 on a shaft 85.

The shaft 85 on its other end has a gear 86 which is in driving engagement with a gear 87 on a shaft 88 to provide power input to the turnaround section C.

The gear 86 is in driving engagement with a gear 89 secured to the shaft 30 which gear 89 is in driving engagement with a gear 90 secured to the shaft 30*a*.

The gear 86 is also in driving engagement with a gear 91 secured to the shaft 33*a*, which gear 91 is in driving engagement with a gear secured to the shaft 33.

The gear 86 is also in driving engagement with a gear 93 secured to the shaft 34*a* which gear 93 is in driving engagement with a gear 94 secured to the shaft 35.

The turnaround section C has outer rollers 100 to 111 disposed around the outside of the turnaround path, the specific number being determined by the size of the rollers and the size and shape of the turnaround path. The rollers 100 to 111 are secured to shafts 114 to 125, inclusive, journaled in the end plates 10 and 11.

Inner rollers 130 to 141 are provided, carried on shafts 143 to 154, inclusive, journaled in the end plates 10 and 11.

Converging guide plates 160 can, if desired, be provided at the entrance to the turnaround section C at the rollers 100 and 130 and converging guide plates 161 can, if desired, be provided at the exit from the turnaround section C.

The inner rollers 130 to 140, inclusive, do not touch nor are they radially aligned with the outer rollers 100 to 110, inclusive, but are offset backwards along the turnaround path. Or, stated another way, a plane through the axis of the shaft 88 and the axes of each of the shafts 114 to 124 is angularly disposed in advance of a plane through the axis of the shaft 88 and the axes of each of the shafts 143 to 153.

Figure 10:
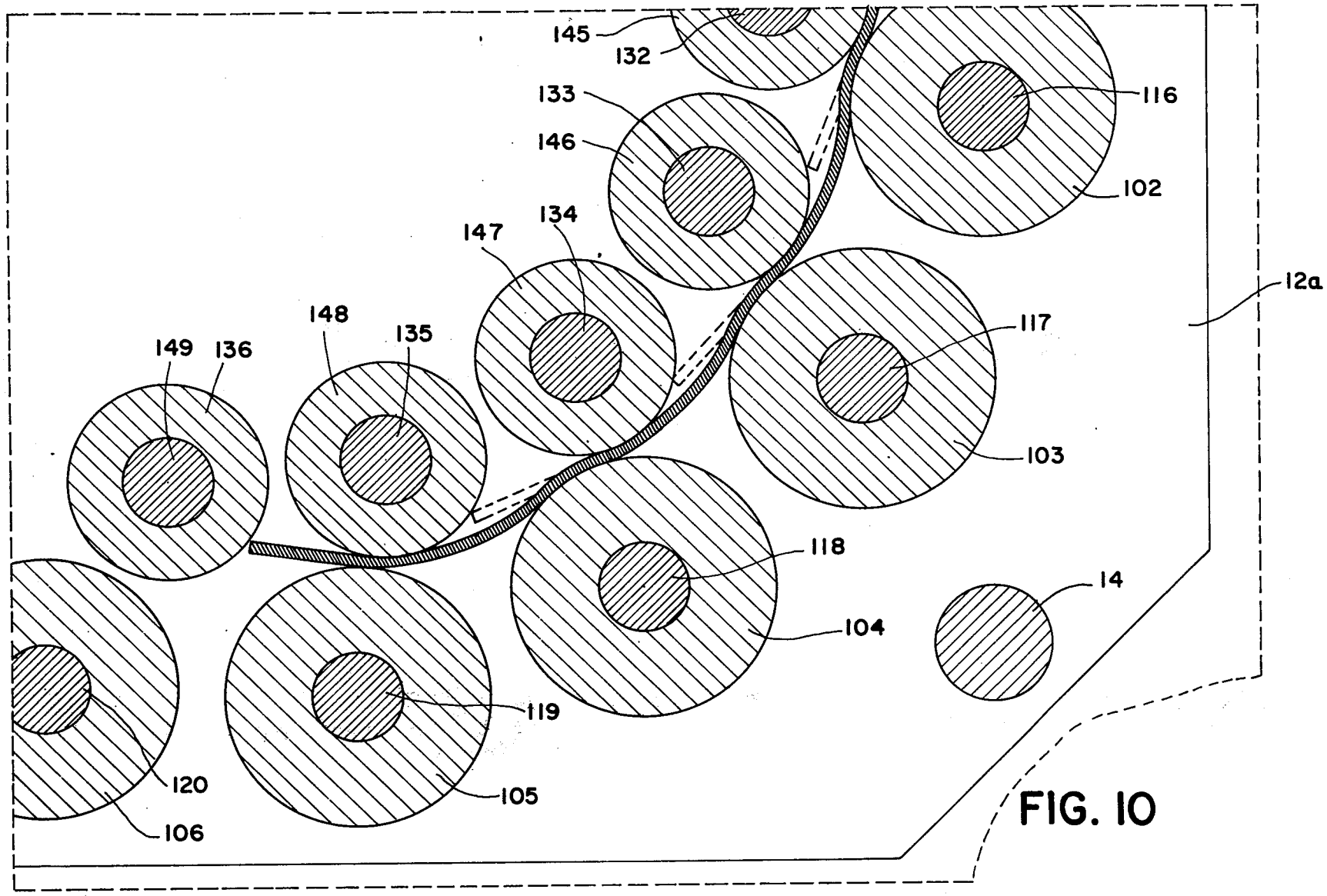
FIG. 10 is an enlarged fragmentary view of a portion of the turnaround structure shown in FIG. 3, showing the passage of a web therethrough.

This arrangement of spaced rollers in the turnaround C directs the web through the turnaround C As will be seen in FIG. 10, a web advancing from engagement by the rollers 145 and 102 tends, as shown in dotted lines, to move towards the roller 146 rather than to the gap between the successive rollers. The web is guided and directed by roller 146 in a tangential fashion for engagement by roller 103 and the joint action of rollers 146 and 103 directs the web, as before, towards the roller 147. The operation previously described is repeated in the progress of the web through the turnaround C.

The successive bending of the web by its engagement with successive rollers is effective for impelling the web without the necessity for simultaneously gripping the web at directly opposite locations as has heretofore been done with nip rollers.

The web is never squeezed and a free flow of processing fluid is effective in contact with the web.

The action previously described is repeated in the course of the advance along the turnaround path so that the web and its deflection causes it to engage successively with the inner and outer rollers with sufficient force so that the web is propelled along the turnaround path.

The power requirements for driving the system are greatly reduced.

A better exposure of the film to the processing fluid is effected at the critical point of processing which is usually at the turnaround.

Maximum agitation of the processing fluid is available by the location of the rollers.

Improved transport of the web through the turnaround, and without skewing is also obtained.

The location of the rollers requires a compact drive because of the overlap of the pitch circles and periperal circles of the gears of the drive and a preferred embodiment of which will now be described. The gears employed in this gear drive are preferably of synthetic plastic material as previously described.

The gear 87 has a plurality of gears 160 to 171, inclusive, in driven relation thereto, the gears 160 to 171, inclusive, being secured respectively to the shafts 114 to 125, inclusive, for driving the outer rollers 100 to 111, inclusive.

The shaft 114 (see FIGS. 4, 5, and 9) has an outer blank 156 of disc shape with an inwardly facing hub, similar in size and shape to a gear but without teeth to provide with a gear 157 therebehind a slot 158. The blank 156 is held in place by a washer 159 in engagement with the shaft 114. The shaft 143 has an inwardly disposed gear 161 with a flange 162 rotatable within the slot 158 and an outwardly facing hub 163. The gear 161 is held on the shaft by a washer 159.

The shaft 115 (see FIGS. 4, 5 and 6) has an outwardly disposed gear 164 thereon and a blank 156 therebehind, the gear 164 being in driving relation to a gear 165. The gear 165 is a flanged gear similar to the gear 161 but with its hub inwardly disposed, the gears 164 and 165 being retained by washers 159 in the same manner as the other gears in this section.

The shaft 116 (see FIGS. 4, 5, and 7) has an outwardly disposed blank 156 and an inwardly disposed gear 166 thereon, the gear 166 being in driving engagement with a flanged gear 167 similar to the gear 161.

The shafts 117, 119, 121 and 123 (see FIGS. 4 and 5) have outwardly disposed gears similar to the gear 164 and inwardly disposed blanks 156, 168, 169, 170 and 171 carried thereon which gears are in driving engagement respectively with flanged gears 173, 174, 175 and 176, similar to the flanged gear 165, on the shafts 133, 135, 137, and 139.

The shafts 118, 120, 122 and 124, have outwardly disposed blanks 156 and inwardly disposed gears 178, 179, 180 and 181 thereon similar to the gear 166, in driving engagement respectively with flanged gears 182, 183, 184 and 185, similar to the gear 167, on shafts 134, 136, 138 and 140. The gears in the inner row are longitudinally axially retained in alignment by their flanges in engagement in contiguous slots in the manner previously pointed out with respect to gear 161.

The shaft 125 (see FIGS. 4, 5 and 8) has a gear 187 thereon in driving engagement with a gear 188 on the shaft 154.

The mode of operation should be apparent from the foregoing but will be summarized briefly.

An elongated web of desired length is introduced into the infeed section A between the rollers 20 and **20*a* and is advanced between the rollers 22 and 22*a* and is guided by the guide plate 31 in the the downfeed section B with its feed rollers 27 and 27*a*. The downfeed section while shown as short can have additional feed rollers dependent on the height of the end frames 10 and 11**.

From the downfeed section B the web is advanced along the turnaround path of the turnaround section C.

In this section the web is successively contacted by the spaced rollers of the outer and inner rows and is bent and continued in a curved path as pointed out above.

The web is advanced to and through the upfeed section D, and advanced between the rollers 34 and **34*a***. The upfeed section D is of a length to correspond to that of the downfeed section B.

The web is advanced to and through the delivery section E, and between the pairs of rolls 36 and **36*a*, 38 and 38*a*, 40 and 40*a*, and 42 and 42*a***, for discharge.

The manner in which the rollers of the respective sections are driven has heretofore been pointed out in detail and reference may be had thereto.

It will thus be seen that apparatus has been provided with which the objects of the invention are attained.

We claim:

1. Apparatus for conveying an elongated web for turnaround in a confined space comprising spaced frame members, a plurality of web engaging rollers rotatably supported by said frame members, said rollers comprising a plurality of spaced outer rollers with their longitudinal axes disposed parallel to each other and in spaced relation outwardly of a curved turnaround path, a plurality of spaced inner rollers with their longitudinal axes disposed parallel to each other and in spaced relation inwardly of a curved turnaround path, a plurality of pairs of contiguous inner and outer rollers engaging the web and having a gap therebetween through which the web is directed and advanced toward an inner of the rollers of the next contiguous pair of inner and outer rollers for deflection into and through the gap of said next pair, said pairs of contiguous inner and outer rollers being disposed so that a plane through the center of the turnaround path and the longitudinal axis of an inner roller is angularly disposed with respect to a plane through the center of the turnaround path and the longitudinal axis of the outer roller, and means for rotating said rollers.

2. Apparatus for conveying a web as defined in claim 1 in which said first mentioned plane is disposed in a trailing direction along said path.

3. Apparatus for conveying a web as defined in claim 1 in which said rollers comprise groups of rollers, and said means for rotating said rollers includes driving members for one of said groups and driving connections therefrom to another of said groups.

4. Apparatus for conveying a web as defined in claim 3 in which said driving members include gears carried by a pair of successive outer rollers in driving engagement with gears carried by a contiguous pair of successive inner rollers, the gears for one of said outer rollers and for the inner roller driven therefrom being disposed at an outward location and the gears for the other of said outer rollers and the inner roller driven thereby being disposed inwardly of said outward location.

5. Apparatus for conveying a web as defined in claim 4 in which the gears for an inner and outer roller driven together have portions engaged with the gears for the other inner and outer roller for limiting relative axial displacement of said gears.

6. Apparatus for conveying a web as defined in claim 1 in which said outer rollers comprise a group of rollers, and said means for rotating said rollers includes driving members for said group of rollers.

7. Apparatus for conveying a web as defined in claim 1 in which said inner rollers comprise a group of rollers, and said means for rotating said rollers includes driving members for said group of rollers.

8. Apparatus for conveying a web as defined in claim 7 in which driving members are provided between said outer rollers and said inner rollers for rotating said inner rollers.

* * * * *